US010154931B1

(12) United States Patent
Vann

(10) Patent No.: US 10,154,931 B1
(45) Date of Patent: Dec. 18, 2018

(54) IN SITU BED CHAIR

(71) Applicant: Charles Stuart Vann, El Granada, CA (US)

(72) Inventor: Charles Stuart Vann, El Granada, CA (US)

(73) Assignee: VANNTEC LLC, El Granada, CA (US)

( * ) Notice: Subject to any disclaimer, the term of this patent is extended or adjusted under 35 U.S.C. 154(b) by 522 days.

(21) Appl. No.: 14/956,367

(22) Filed: Dec. 1, 2015

(51) Int. Cl.

| | |
|---|---|
| ***A61G 5/00*** | (2006.01) |
| ***A61G 7/018*** | (2006.01) |
| ***A61G 7/015*** | (2006.01) |
| ***A61G 5/12*** | (2006.01) |

(52) U.S. Cl.
CPC ..... *A61G 5/006* (2013.01); *A61G 5/12* (2013.01); *A61G 7/015* (2013.01); *A61G 7/018* (2013.01); *A61G 2005/122* (2013.01); *A61G 2005/127* (2013.01)

(58) Field of Classification Search
CPC ..... A61G 7/008; A61G 13/04; A61G 7/001
See application file for complete search history.

(56) References Cited

U.S. PATENT DOCUMENTS

| | | | | | |
|---|---|---|---|---|---|
| 3,013,281 | A * | 12/1961 | Steiner | A61G 7/008 | 5/108 |
| 4,244,358 | A * | 1/1981 | Pyers | A61G 7/002 | 5/607 |
| 5,625,913 | A * | 5/1997 | Singleton | A47C 21/006 | 5/430 |
| 7,073,222 | B1 * | 7/2006 | Skripps | A61G 13/04 | 5/607 |
| 7,219,380 | B2 | 5/2007 | Beck et al. | | |
| 7,246,389 | B2 * | 7/2007 | Taguchi | A61G 7/001 | 5/608 |
| 7,296,315 | B2 | 11/2007 | Totton et al. | | |
| 9,044,368 | B2 | 6/2015 | Fairburn et al. | | |
| 2002/0016994 | A1 * | 2/2002 | Hand | A61G 7/008 | 5/600 |
| 2004/0011779 | A1 * | 1/2004 | Krywiczanin | A61G 7/001 | 219/217 |
| 2007/0163584 | A1 * | 7/2007 | Bohm | A61G 7/008 | 128/204.18 |
| 2015/0020312 | A1 * | 1/2015 | Baumann | A61G 7/008 | 5/609 |

* cited by examiner

*Primary Examiner* — Eric J Kurilla

(57) ABSTRACT

In accordance with one embodiment, an In situ Bed Chair (IBC) rotates back and forth and has elevating and lowering bed sections. In a second embodiment, the IBC converts from a flat bed into a chair or vice a versa such that a patient can remain in place during the conversion. The chair has wheels that enable easy transport of the patient to other locations.

14 Claims, 5 Drawing Sheets

IN SITU BED CHAIR

CROSS-REFERENCE TO RELATED APPLICATIONS

None

FEDERAL SPONSORED RESEARCH

Not applicable

SEQUENCE LISTING OF PROGRAM

Not applicable

BACKGROUND—PRIOR ART

| U.S. Patents | | | |
|---|---|---|---|
| Pat. No. | Kind Code | Issue Date | Patentee |
| 9,044,368 | B2 | 2015 Jun. 2 | Fairburn, et al. |
| 7,296,315 | B2 | 2007 Nov. 20 | Totton, et al. |
| 7,219,380 | B2 | 2007 May 22 | Beck, et al. |

Beds have been used by people for thousands of years to make lying down more comfortable. In normal circumstances, a simple bed is acceptable. However, if a person is incapacitated because of sickness or injuries, several problems arise with a standard bed.

First, the patient may be unable or unwilling to move their body positions often enough to prevent pressure ulcers (bed sores) from forming. If others turn the patient, it often takes several people at a frequency of many times per day to prevent pressure ulcers from forming. Even in hospitals with dedicated staff to regularly turn patients, pressure ulcers still occur and thousands of patients die each year from this problem.

Fairbum, et al. (U.S. Pat. No. 9,044,368), Totton, et al. (U.S. Pat. No. 7,296,315), and Beck, et al. (U.S. Pat. No. 7,219,380) all disclose bed mattress with many inflating and deflating subsections that redistribute pressure of the patient. However, this approach requires expensive and complex mattresses and automated controls.

Furthermore, these devices actually increase the magnitude of pressure on the body. Because the body position doesn't change, a subsection of the body surface must support the patient's body weight. When some of the mattress deflates under this finite area, the body area supporting the weight is reduced even more such that pressure in this smaller area actually increases, making the chance of a pressure ulcer even more likely.

The second problem with a standard bed is the difficulty moving an incapacitated person when they are in bed. Often, a patient needs to be moved to perform a task such as changing a sheet or a bandage. With an incapacitated patient, this movement can be a major physical effort that risk injury to those moving the patient as well as the patients themselves.

The third problem is the restrictions and discomfort of a flat standard bed. If a patient wants to eat, watch TV, read, etc., tilting the upper body to an elevated angle relative to a horizontal mid-body is often more comfortable. Furthermore, lowering the legs relative to a horizontal mid-body can also be more comfortable. A standard bed does not make these adjustments.

The fourth problem is the difficulty of moving an incapacitated person in and out of a standard bed. Depending on the size of the person, several people may be necessary to move an incapacitated person from a standard bed so as to stand or sit in a chair. This movement can result in physical injuries to the incapacitated person as well as those assisting.

The fifth problem with a standard bed is patient transport to other locations. An incapacitated person may want to relocate to a bathroom, cafeteria, chapel, or an outdoor porch. However, a standard bed is impractical to move.

SUMMARY

In accordance with a first embodiment, an In situ Bed Chair (IBC) rotates back and forth to reduce the time any one section of the patient's body supports their weight, greatly reducing the chance of pressure ulcers. Furthermore, the ability to rotate the patient enables easier and safer performance of in-bed tasks such as changing bandages, replacing sheets, or applying medication.

In a second embodiment, the IBC converts from a flat bed into a chair or vice a versa such that a patient can remain in place (in situ) during the conversion, avoiding potential harm to the patient and the assistants. The elevating and lowering of some sections of the bed can provide more comfort for the patient when reading, eating, or watching TV. Furthermore, with wheels under the chair, the patient can be easily transported to other locations.

Advantages

Accordingly, an In situ Bed Chair (IBC) rotating back and forth, reducing the time that any one part of the body supports the body weight, and consequently, lowering the chance of a pressure ulcer forming. A rotating bed also enables assistants to easily and safely move an incapacitated person in bed. Also, rocking motion helps many to fall asleep and stay asleep, potentially avoiding sleeping pills that can have dangerous side effects.

In a second embodiment, the IBC converts from a bed into a chair or vice a versa such that a patient can remain in place during the conversion, reducing the physical effort and chance of injury to the patient and assistants. Elevating and lowering sections of the IBC provide more comfort for the patient when eating, reading, and watching TV. The chair has wheels that enable easy transport of the patient to other locations.

DRAWINGS—REFERENCE NUMERALS

Figure 1:
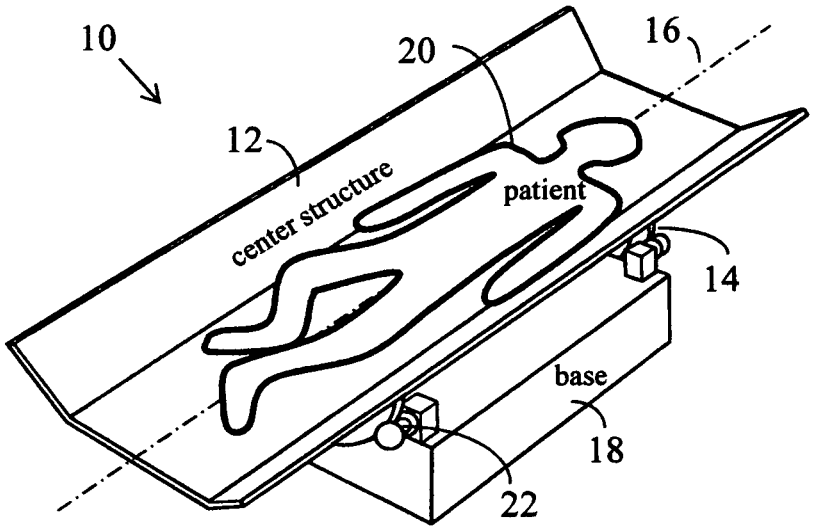
FIG. 1 shows an isometric view of a first embodiment IBC.

10 first embodiment IBC
12 center support
14 semicircle surface
16 centerline
18 base
30 patient
22 bearing
24 center support motor
26 gear
28 gear teeth
30 center support teeth
40 second embodiment IBC
42 wheel
44 head support
46 foot support
48 base extension
50 head support motor
52 foot support motor
54 controller

DETAILED DESCRIPTION

First Embodiment—FIGS. 1 Through 4

Figure 2:
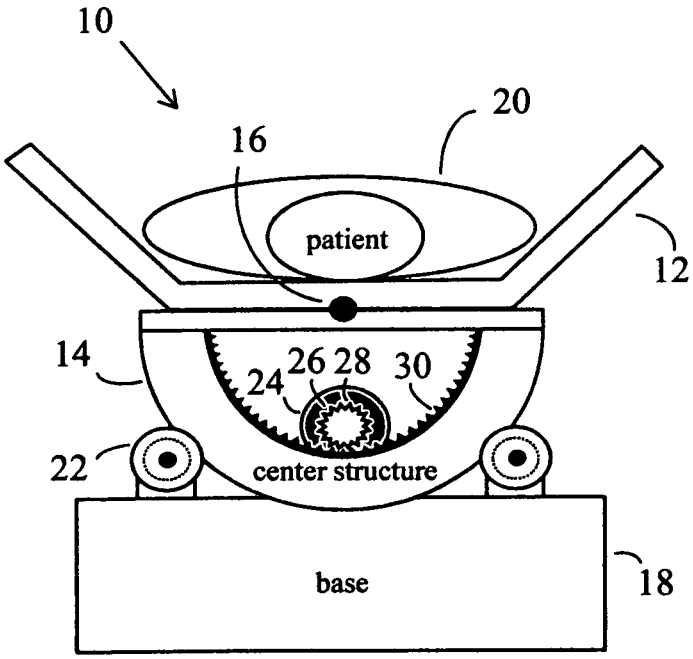
FIG. 2 shows an end view of first embodiment IBC.
Figure 3A:
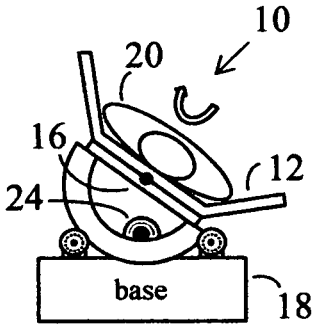
FIGS. 3A to 3C show end views of three positions of a patient rotated in first embodiment IBC.
Figure 3B:
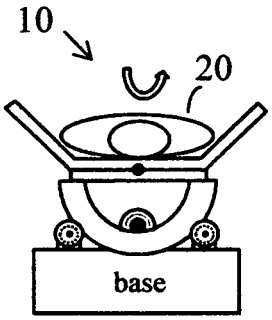
Figure 3C:
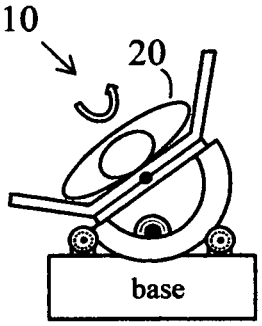
Figure 4:
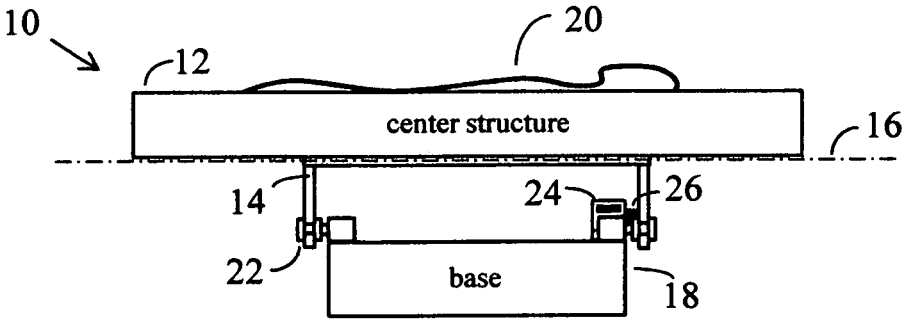
FIG. 4 shows a side view of first embodiment IBC.

The first embodiment IBC 10 is illustrated in FIG. 1 (isometric view), FIGS. 2 and 3 (end views), and FIG. 4 (side view). FIG. 1 shows that IBC 10 consists of a center support 12 with one or more semicircle surfaces 14 having the same centerline 16 and in contact with and supported by a base 18. A patient 20 can comfortably lie down on center support 12. Bearings 22 attached to base 18 are in contact with semicircle surfaces 14 supporting the weight of center support 12 while still allowing center support 12 to rotate about centerline 16.

FIG. 2 shows an end view of IBC 10. Semicircle surfaces 14 of center support 12 rests on bearings 22 that are attached to base 18. Bearings 22 support center support 12 while permitting rotation of center support 12 about centerline 16. Center support motor 24 is also attached to base 18 and rotates gear 26 having gear teeth 28. Gear teeth 28 make contact with center support teeth 30 such that rotation of center support motor 24 rotates center support 12 about centerline 16. Gear 26 and gear teeth 28 can be replaced with a friction wheel (not shown), and center support teeth 30 can be replaced with friction surface (not shown).

FIGS. 3A to 3C show three end views of center support 12 rotating about centerline 16. Gear 26 is in contact with center support 12 such that rotation of center support motor 24 rotates center support 12 about centerline 16. In FIG. 3A, the right side of patient 20 supports much of the body weight while the left side is pressure free. In FIG. 3B, the back of patient 20 supports the body weight while the left and right side are pressure free. In FIG. 3C, the left side of patient 20 supports much of the body weight while the right side is pressure free.

FIG. 4 shows a side view of IBC 10.

Second Embodiment—FIGS. 5 Through 10

Figure 5:
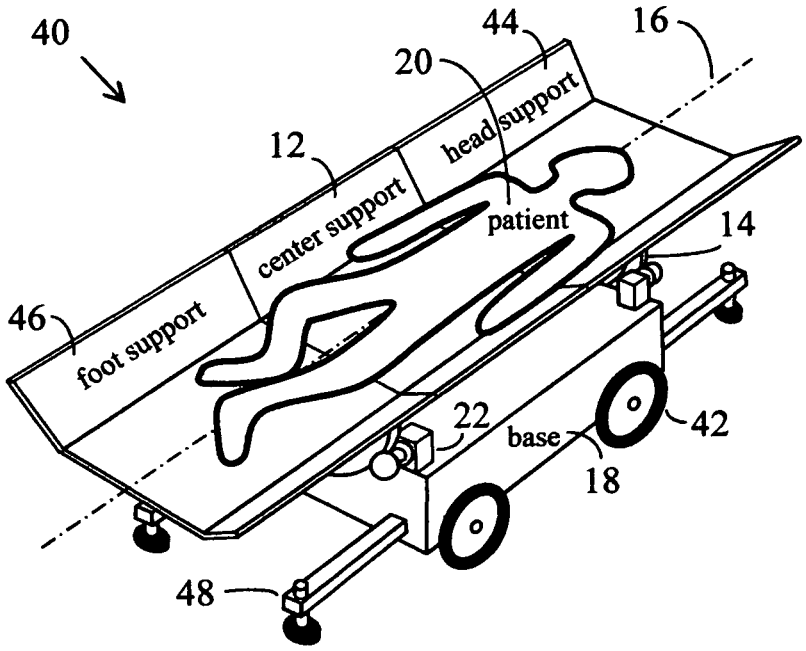
FIG. 5 shows an isometric view of a second embodiment IBC.
Figure 6:
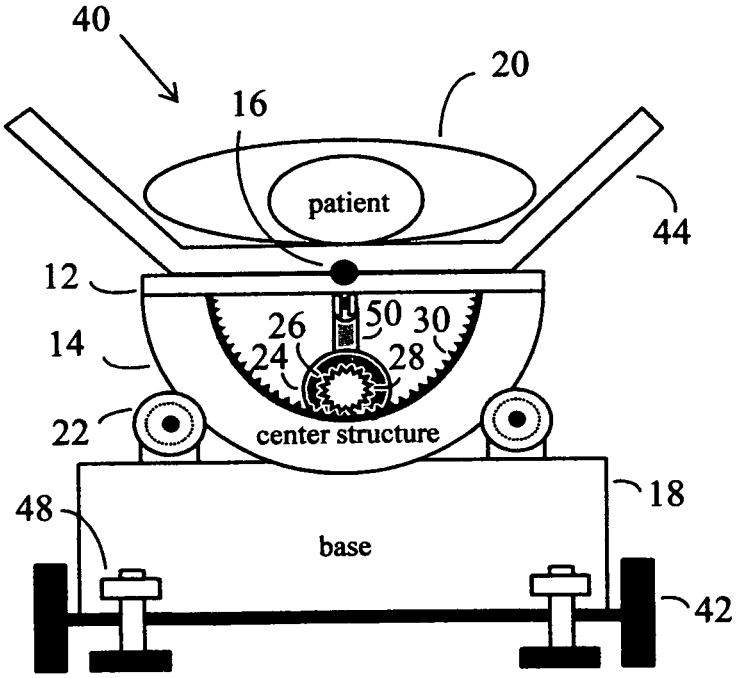
FIG. 6 shows an end view of second embodiment IBC.
Figure 7A:
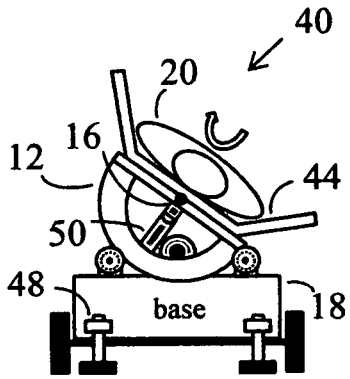
FIGS. 7A to 7C show end views of three positions of a patient rotated in second embodiment IBC.
Figure 7B:
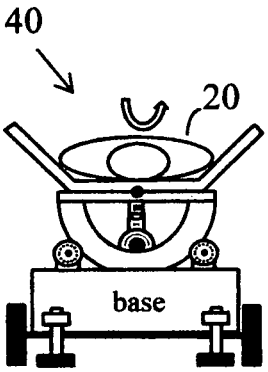
Figure 7C:
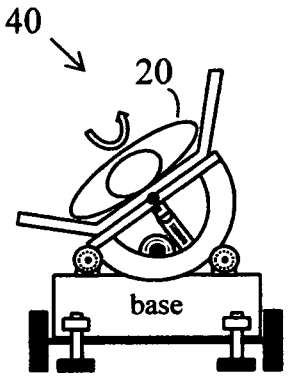
Figure 8:
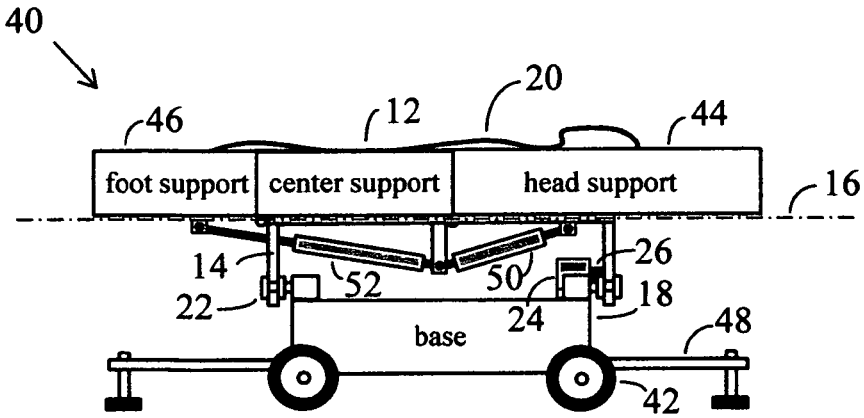
FIG. 8 shows a side view of second embodiment IBC in a bed configuration.
Figure 9:
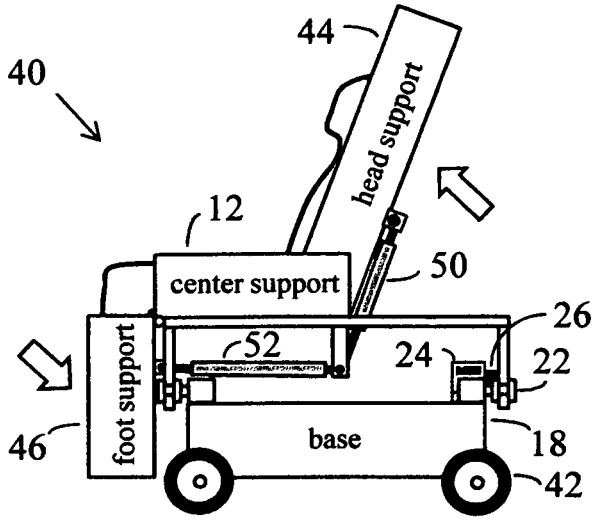
FIG. 9 shows a side view of second embodiment IBC in a chair configuration.
Figure 10:
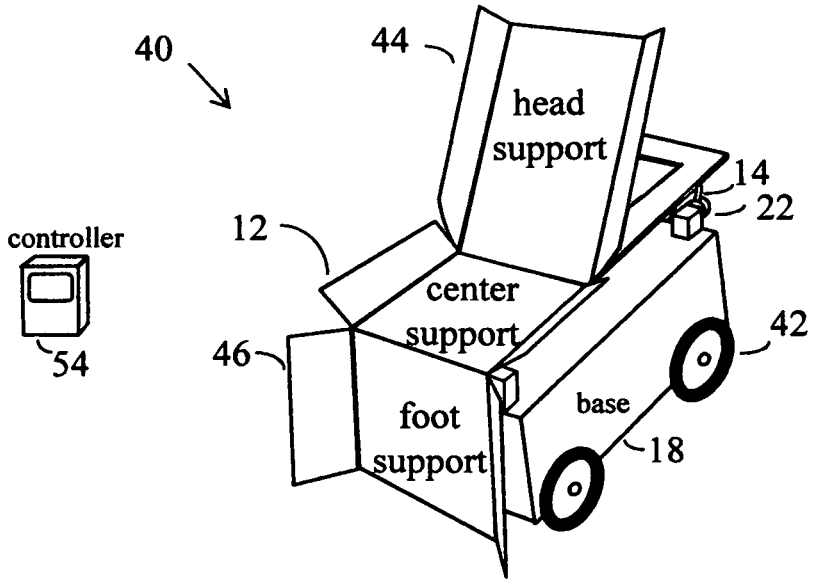
FIG. 10 shows an isometric view of second embodiment IBC in a chair configuration.

The second embodiment IBC 40 is illustrated in FIGS. 5 and 10 (isometric views), FIGS. 6 and 7 (end views), and FIGS. 8 through 9 (side views). FIG. 5 shows that IBC 40 consists of a center support 12 with one or more semicircle surfaces 14 having the same centerline 16 and in contact with and supported by base 18. Wheels 42 are attached to base 18 such that IBC 40 can be transported on wheels 42.

Bearings 22 attached to base 18 are in contact with semicircle surfaces 14 supporting the weight of center support 12 while still allowing center support 12 to rotate about centerline 16. A head support 44 is pivotally attached to one side of center support 12, and a foot support 46 is pivotally attached to the opposite side of center support 12.

Furthermore, one or more base extensions 48 can be extracted from base 18 to rest on a floor, adding more standing stability to IBC 40.

FIG. 6 shows an end view of IBC 40. Semicircle surfaces 14 of center support 12 rests on bearings 22 that are attached to base 18. Bearings 22 support center support 12 while still enabling center support 12 to rotate about centerline 16. Center support motor 24 is also attached to base 18 and rotates gear 26 that has gear teeth 28. Gear teeth 28 make contact with center support teeth 30 such that rotation of center support motor 24 rotates center support 12 about centerline 16.

Head support motor 50 is attached to center support 12 and head support 44 so as to rotate head support 44 about center support 12. Foot support motor 52 (shown in FIG. 7) is attached to center support 12 and foot support 46 so as to rotate foot support 46 about center support 12.

FIGS. 7A to 7C show three end views of center support 12 rotating about centerline 16. Gear 26 is in physical contact with center support 12 such that rotation of center support motor 24 rotates center support 12 about centerline 16. In FIG. 7A, the right side of patient 20 supports much of the body weight while the left side is pressure free. In FIG. 7B, the back of patient 20 supports the body weight while the left and right side are pressure free. In FIG. 7C, the left side of patient 20 supports much of the body weight while the right side is pressure free.

FIG. 8 shows a side view of IBC 40 with head support 44, center support 12, and foot support 46 in a substantially horizontal line such that patient 20 is in the lying position. FIG. 9 shows a side view of IBC 40 with head support 44 elevated relative to a horizontal center support 12 by head support motor 50, and foot support 46 lowered relative to a horizontal center support 12 by foot support motor 52 such that patient 20 is in the sitting position. Head support motor 50 and foot support motor 52 can be operated by a source of energy, typically electric current, hydraulic fluid pressure, or pneumatic pressure, and converts that energy into motion.

FIG. 10 shows an isometric view of IBC 40 as a chair. Furthermore, a wireless controller 54 enables patient 20 to control center support motor 24, head support motor 50, and foot support motor 52.

Operation of First Embodiment IBC 10—FIGS. 1 Through 6

One of many applications for this invention will be a hospital bed. An incapacitated patient 20 is vulnerable to pressure ulcers due to their inability to frequently change their body position. Thus, thousands of patients die every year due to pressure ulcers than can be prevented with this invention.

First embodiment IBC 10 can automatically and frequently change the position of patient 20 by rotating center support 12 about centerline 16. Rotational force is provided by center support motor 24. Gear teeth 28 are in contact with center support teeth 30 such that when center support motor 24 rotates, center support 12 rotates about centerline 16. The rotation tilts patient 20 relative to horizontal. At some tilt angle, rotation can be reversed to tilt patient 20 at some tilt angle in the opposite direction. A consistent reversal of tilting provides a rocking motion of center support 12. Furthermore, center support 12 can be rotated by center support motor 24 to some tilt angle and held in place for an indefinite amount of time (rotation and hold), providing safer and easier access to patient 20. Controller 54 enables patient 20 and assistants to control the rotation of center support motor 24.

Operation of Second Embodiment IBC 60—FIGS. 5 Through 10

Second embodiment IBC 40 provides all the capability of first embodiment IBC 10 with the added capability of in situ conversion from a bed into a mobile chair without removing patient 20. From a bed arrangement, head support motor 50 elevates head support 44, and foot support motor 52 lowers foot support 46, forming a chair. Patient 20 can remain in IBC 40 during this conversion from a bed to a chair. Wheels 42 enable rolling of IBC 40 from one location to another. Wheels 42 can be locked to prevent inadvertent rolling. Furthermore, support extensions 48 can be extracted from base 18 to rest on a floor, adding more standing stability to IBC 40.

From a chair arrangement, head support motor 50 lowers head support 44, and foot support motor 52 raises foot support 46, forming a bed. Patient 20 can remain in IBC 40 during this conversion from a chair to a bed.

Advantages

From the description above, a number of advantages of my embodiments of an In situ Bed Chair become evident:

(a) The IBC reduces the chance of a pressure ulcer on patients because the time that any one part of the body supports the body weight is greatly reduced by the rotating motion. Unlike a standard bed, the entire back and sides of the body are used to support the patient's body weight but not all at the same time. When the left side of the patient is tilted up (FIG. 3A), the patient supports much of their body weight with the right side of the body while the patient's left side is pressure free. In contrast, when the right side of the patient is tilted up (FIG. 3C), the patient supports much of their body weight with the left side of the body while the patient's right side is pressure free. When the IBC is level (FIG. 3B), the back supports all the body weight and the two sides of the body are pressure free. Thus, the time that any one part of the body supports the body weight is greatly reduced relative to a standard bed where that pressure is continuous.

(b) The IBC enables assistants to more easily and safely move an incapacitated person in bed. Often assistants need to move a patient for some reason such as changing sheets, checking a wound, or applying medications. In a standard bed, it can take several assistants to move an incapacitated patient, risking injury to the patient and assistants. With a controller, a rotation and hold command rotates the patient such that an inaccessible part of their body becomes accessible, and a sequence of partial rotations can make changing a sheet easier. When these tasks are easier, they are also safer and need fewer assistants, saving money and time.

(c) A rocking motion helps many to fall asleep and stay asleep, potentially avoiding sleeping pills that can have dangerous side effects.

(d) The IBC has elevating and lowering sections for more patient comfort when eating, reading, and watching TV. The patient or assistants can use the controller to send commands to the motors to elevate the head section to nearly 90 degrees and lower or raise the foot section to nearly 90 degrees relative to horizontal.

(e) Furthermore, the IBC converts from a flat bed into a mobile chair or vice a versa such that a patient can remain in situ during the conversion, reducing the physical effort and chance of injury to the patient or assistants. Thus, the dangerous and physically demanding task of moving a patient out of bed, often requiring several assistants, is replaced by finger adjusting the values on a controller.

(f) The chair has wheels that enable easy transport of the patient to other locations. Often patients need to be relocated to places such as a bathroom, cafeteria, or lounge. Moving a standard bed to these locations is impractical, but with wheels on the IBC, relocation to other locations is practical and easy.

CONCLUSIONS, RAMIFICATIONS, AND SCOPE

Accordingly, the reader will see that the In situ Bed Chair has many advantages over standard beds. Reducing deaths by pressure ulcers is a particularly important advantage. Even patients that don't die from pressure ulcers often take long periods of time to recover, requiring longer hospital stays and expensive medical bills. Furthermore, the added staff to regularly turn patients is a costly hospital expense that can now be avoided. Furthermore, the IBC has the additional advantages in that:

(a) it enables assistants to more easily and safely move an incapacitated person in bed.

(b) it puts patients asleep and stay asleep with the soothing rocking motion, potentially avoiding sleeping pills that can have dangerous side effects.

(c) it has elevating and lowering sections for more patient comfort to perform tasks in bed such as eating, reading, or watching TV.

(d) it converts from a flat bed into a chair or vice a versa such that a patient can remain in place during the conversion, reducing the physical effort and chance of injury to the patient or assistants.

(e) it has wheels that enable easy transport of the patient to other locations.

Although the description above contains many specificities, these should not be construed as limiting the scope of the embodiment but as merely providing illustrations of some of several embodiments. For example, more or less supports could be attached to the center support with more or less motors to rotate them or none at all. Motors can be operated by a source of energy, typically electric current, hydraulic fluid pressure, or pneumatic pressure, and converts that energy into motion or they can be manually operated device. The base can have wheels, no-wheels, handle bars, or no-handle bars. All kinds of clamps, bolts, bands, ties can hold components in place. Thus, the scope of the embodiment should be determined by the appended claims and their legal equivalents, rather than by examples given.

I claim:

1. A method to change a person support apparatus from support of a person in a substantially lying position that can be rotated back and forth to a substantially sitting position, the method comprising:

a. providing a center support with one or more semi-circular surfaces having substantially the same centerline, b. providing a base that supports said center support, c. providing a means for rotating said center support back and forth about said centerline relative to said base, d. providing a foot support pivotally attached to said center support and rotated to support said person in a substantially lying position, e. providing a head support pivotally attached to said center support and rotated to support said person in a substantially lying position, whereby said foot support can be lowered and said head support can be elevated such that said person support apparatus is changed from support of a person in a substantially lying position than can be rotated back and forth about said centerline to support of a person in a substantially sitting position.

2. The method of claim 1 wherein rotating of said center support about said centerline has said semi-circular surfaces rolling on bearings attached to said base.

3. The method of claim 1, further including transporting said person support apparatus on wheels that are attached to said base.

4. The method of claim 1, further including retracting one or more base extensions into said base to facilitate transporting of said person support apparatus.

5. The method of claim 1 wherein a center support motor that rotates a gear that is in contact with said center support is the means of rotating back and forth said center support.

6. The method of claim 1 wherein a foot support motor pivotally attached to said center support and pivotally attached to said foot support rotates said foot support.

7. The method of claim 1 wherein a head support motor pivotally attached to said center support and pivotally attached to said head support rotates said head support.

8. A method to change a person support apparatus from support of a person in a substantially sitting position to a substantially lying position that can be rotated back and forth, the method comprising:

a. providing a center support with one or more semi-circular surfaces having substantially the same centerline, b. providing a base that supports said center support, c. providing a means for rotating back and forth said center support about said centerline relative to said base, d. providing a foot support pivotally attached to said center support and rotated to support said person in a substantially sitting position, e. providing a head support pivotally attached to said center support and rotated to support said person in a substantially sitting position, whereby said foot support can be elevated and said head support can be lowered such that said person support apparatus is changed from support of a person in a substantially sitting position to support of a person in a substantially lying position than can be rotated back and forth about said centerline.

9. The method of claim 8 wherein rotating of said center support about said centerline has said semi-circular surfaces rolling on bearings attached to said base.

10. The method of claim 8, further including a means of preventing wheels attached to said base from rolling so as to make said base stationary.

11. The method of claim 8, further including extracting one or more base extensions from said base to add standing stability to said person support apparatus.

12. The method of claim 8 wherein a center support motor that rotates a gear that is in contact with said center support is the means of rotating back and forth said center support.

13. The method of claim 8 wherein a foot support motor pivotally attached to said center support and pivotally attached to said foot support rotates said foot support.

14. The method of claim 8 wherein a head support motor pivotally attached to said center support and pivotally attached to said head support rotates said head support.

* * * * *